United States Patent [19]

Kunz et al.

[11] 4,203,585

[45] May 20, 1980

[54] DOCUMENT FEED FOR A COPIER MACHINE

[75] Inventors: Barton H. Kunz, Longmont; Myron F. Shlatz; Jesse W. Spears, both of Boulder, all of Colo.

[73] Assignee: International Business Machines Corporation, Armonk, N.Y.

[21] Appl. No.: 926,979

[22] Filed: Jul. 21, 1978

[51] Int. Cl.[2] ..... B65H 3/52

[52] U.S. Cl. ..... 271/4; 271/10; 271/111; 271/113; 271/118; 271/119; 271/121

[58] Field of Search ..... 271/110, 111, 113, 114, 271/118, 119, 121, 10, 4

[56] References Cited

U.S. PATENT DOCUMENTS

| | | | |
|---|---|---|---|
| 3,588,094 | 6/1971 | Bost | 271/121 |
| 3,747,918 | 7/1973 | Margulis | 271/4 |
| 3,900,192 | 8/1975 | Gibson | 271/121 X |
| 4,023,791 | 5/1977 | Hori | 271/3 |
| 4,062,533 | 12/1977 | Greenberg | 271/10 |
| 4,089,516 | 5/1978 | Colglazier | 271/121 X |
| 4,097,041 | 6/1978 | Fujimoto | 271/121 X |

OTHER PUBLICATIONS

IBM Technical Disclosure Bulletin, vol. 14, No. 5, Oct. 1971, p. 1547.

*Primary Examiner*—Richard A. Schacher
*Attorney, Agent, or Firm*—Charles E. Rohrer

[57] ABSTRACT

A document feed mechanism for a copier machine incorporating an automatic document feed (ADF) with a semi-automatic document feed (SADF) and enabling the SADF to interrupt the ADF. The ADF tray upon which a stack of documents to be copied is placed is situated directly above the viewing station. A wave generator (shingler) paper feed means fans out the topmost sheets on the stack and up a ramp until the topmost sheet enters closed nip rollers. The nip rollers, together with aligner rollers and a drive belt, move the sheet around a substantially 180° bend and onto the viewing station. Second sheet feeds are prevented by a restraint pad positioned between the nip rollers and the exit of the ramp, the top of the restraint pad being above the nip of the nip rollers so that the topmost sheet presses a second sheet downwardly into the restraint pad. The SADF feeds sheets onto the viewing station using the aligner rolls and the drive belt.

3 Claims, 9 Drawing Figures

DOCUMENT FEED FOR A COPIER MACHINE

This invention relates to document copier machines and more specifically to preventing double sheet feeds in an automatic document feed device.

BACKGROUND OF THE INVENTION

Document copying machines often require that a document be held in a stationary manner face down on a document glass in order to be copied. Frequently, in a convenience copier of this type, it is necessary for the operator to place the document on the document glass manually. However, it has also been recognized that it is desirable to afford the operator the opportunity to place a stack of documents upon a feed tray and have the machine feed these documents one-at-a-time onto the document glass for the copying operation. Mechanisms of this type are known as automatic document feeds (ADF).

A serious problem confronted by machines which attempt to automatically feed cut sheets of paper serially to a processing mechanism is the difficulty encountered in avoiding a multiple-sheet feed. While many different kinds of cut-sheet feed devices have been invented and many improvements have been made, the multiple-sheet feed problem remains and is particularly serious in automatic document feed mechanisms for a convenience copier due to the fact that a stack of sheets to be copied can contain various weight paper ranging from light-weight "onionskin" paper to much heavier bond paper.

One of the most successful paper feed devices is the so-called "wave generator" wheel or "shingler" wheel whose operation causes the paper stack to be moved from its stacked condition to a fanned out "shingled" state. In the shingled state, a pair of feed rolls can then reliably grasp the topmost (or bottommost) sheet which has been moved further than the other sheets and send it to the processing station. However, while the fanning out action of the wave generator wheel is very reliable, double-sheet feeds can still occur, particularly where the next sheet sticks to the sheet being fed. Such sticking is typically caused by static electricity. As a consequence, a major benefit of the present invention is to provide against multiple-sheet feeding in an automatic document feed. This benefit has been achieved through a unique arrangement of the guides in the paper path together with a restraint pad.

SUMMARY OF THE INVENTION

This invention provides an automatic document feed including an ADF tray for holding a stack of documents. A wave generator is used for acting upon the topmost sheet of the stack to feed the stack of sheets in a "shingled" manner up a ramp, across a restraint pad, and down to the nip of a closed pair of nip rollers. Thereafter, the nip rollers are reactivated to feed the topmost sheet upon command.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DESCRIPTION OF THE PREFERRED EMBODIMENT

Figure 1:
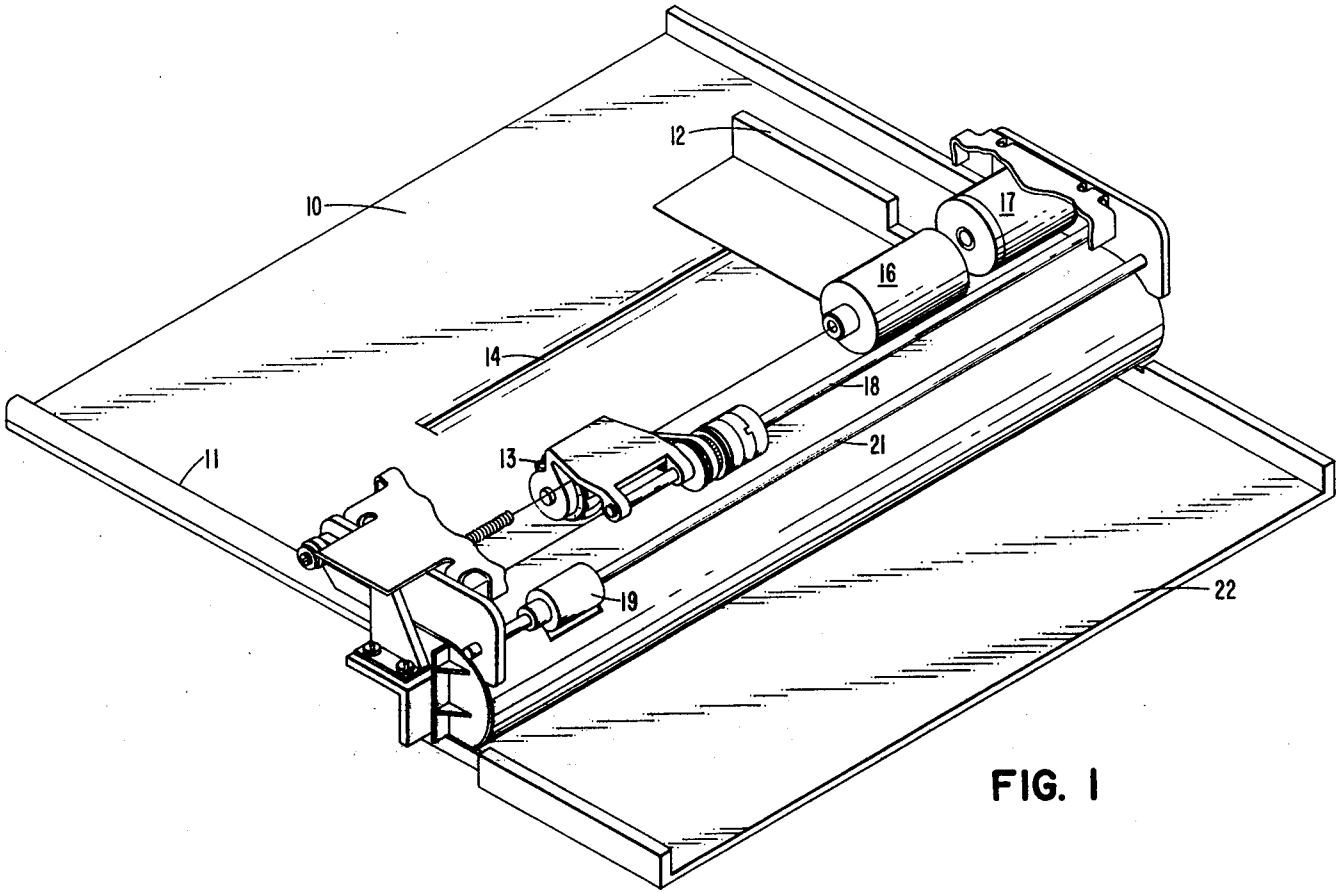
FIG. 1 is a view in perspective of the ADF mechanism.

FIG. 1 is a perspective view of the ADF mechanism showing an ADF tray 10 upon which an operator would place a stack of sheets. The stack would be placed against the guide edge 11 and moved into the ADF device under the wave generator wheel 13 and up against a gate 15 shown in FIG. 2. A movable edge guide 12 may then be moved in track 14 to abut the edge of the document stack opposite to the edge abutting guide 11.

FIG. 1 also shows a solenoid 16 for lowering the wave generator wheel 13 onto the topmost sheet of the document stack. A motor 17 drives the wave generator wheel 13 through a shaft 18 and a transmission, not shown. Motor 17 also drives nip roller 19 through shaft 21. A semiautomatic document feed (SADF) tray 22 is also shown.

Figure 2:
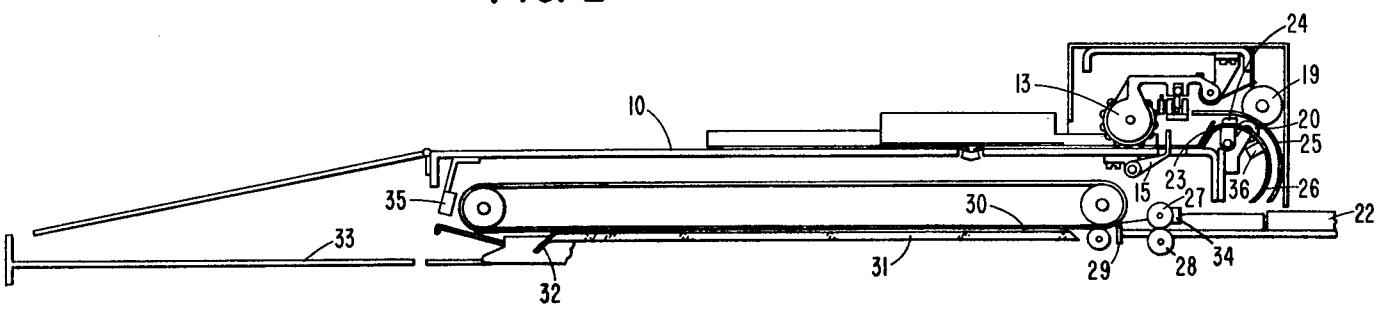
FIG. 2 is a view of the paper path through the ADF, the SADF, the document glass and the exit gate.

FIG. 2 shows a side view of the paper path of the ADF and SADF mechanisms. ADF paper tray 10 is shown with the wave generator wheel 13 in a position to contact a sheet of paper directly upon the tray. In order to place a stack of sheets onto tray 10, wave generator wheel 13 is raised through spring action available by deenergizing solenoid 16, shown in FIG. 1, thus allowing the paper stack to be inserted under wheel 13 against gate 15. Once the paper has been positioned properly, the ADF gate 15 may be lowered. Thereupon, the wave generator wheel 13 is lowered and the topmost sheets of the stack are shingled off of the stack, up the ramp 23, across the opening between paper guide 25 and restraint pad 24, into the nip of closed rollers 19 and 20. Once the topmost sheet is within the nip of rollers 19 and 20 it is moved around a 180° bend formed by paper guides 25 and 26 and into the nip of aligning rollers 27 and 28. From there the paper passes over a retracted entry gate 29 into the influence of document feed belt 30 which moves the document across document glass 31 to the positioning (exit) gate 32. After a copy has been made, positioning gate 32 is retracted and belt 30 moves the copy paper to the exit tray 33.

FIG. 2 also shows SADF tray 22 which the operator may utilize to pass one sheet of paper at a time into aligning rollers 27 and 28 against the raised entry gate 29. At the proper time, entry gate 29 retracts and the document is fed by rolls 27 and 28 and belt 30 to and upon the document glass 31 until the leading edge of the document reaches exit gate 32. At the conclusion of the copying cycle, exit gate 32 is retracted and the document is again fed by belt 30 onto exit tray 33.

The operation of the device is as follows. When feeding a single sheet by utilizing the SADF the operator places a single document face down onto SADF tray 22. As the operator pushes the document forward into the area of aligning rolls 27 and 28, entry sensor 34 registers the presence of the document and turns on aligning rolls 27 and 28 which are preferably driven by their own separate motor. The aligner rollers are driven for a sufficient time period to enable the document to be registered against the entry gate 29. After registration, the entry gate 29 is dropped through the use of a solenoid, not shown, and the main drive belt 30 is started. Preferably, drive belt 30 is also driven through its own separate motor. The aligner rolls 27 and 28 are then restarted to cooperatively feed the document, together with the drive belt 30, from the entry tray 22 across the document glass platen 31. The aligner rolls are stopped and the entry gate 29 is reset by a trailing edge signal generated as the document leaves the entry sensor 34. Meanwhile the main drive belt 30 continues running for a sufficient time to feed the document to the positioning gate 32.

Either after the document has been imaged or during the copying process, the positioning gate 32 is dropped by a solenoid, not shown. After imaging is complete, the main drive belt 30 is restarted to feed the document into the exit tray area 33.

When the automatic document feed is being utilized, the operator places a stack of documents face up onto the tray 10 and pushes the stack against the gate 15, which activates an ADF switch, not shown. Feeding of the documents is initiated when the operator presses the machine start button. Since the ADF switch has been activated, machine logic is enabled to discriminate between ADF operating mode and manual mode and thus the need for a special ADF mode start button is eliminated.

Upon activation the ADF gate 15 is dropped through solenoid action and ADF motor 17 is turned on. This motor drives both the wave generator wheel 13 and the nip rollers 19 and 20. Shingler solenoid 16 is energized to cause wave generator wheel 13 to drop onto the paper stack and feed the top sheet of the stack into the nip of rollers 19 and 20. A nip sensor 36 is located at the nip, and when paper is sensed, dynamic braking is applied to the motor 17, thus stopping the motor quickly. Thereupon wave generator wheel 13 is lifted from the document stack by deenergizing solenoid 16. ADF motor 17 is then restarted, the aligner roll motor is started, the entry gate and exit gates drop and the main drive belt 30 is started. The exit gate 32 is restored after a short preset time interval after enabling any document inadvertently left on the platen 31 to exit the platen. Motor 17 drives nip rollers 19 and 20 to feed the top document around turnaround guides 25 and 26 to the aligner rolls 27 and 28. As the document leading edge makes the entry sensor 34, a timer is set which stops the main belt motor after a time delay just long enough to allow the document to have reached the positioning (exit) gate 32. When the document trailing edge moves past nip sensor 36 the wave generator wheel 13 is dropped onto the paper stack to feed the next document into the nip of rollers 19 and 20, thereupon making the nip sensor 36 and dynamically braking motor 17. When the document trailing edge drops the entry sensor 34 the aligner rolls 27 and 28 are stopped and the entry gate 29 is restored.

After the document is copied the exit gate 32 is dropped and main drive belt 30 is restarted to move the document from the platen 31. As the document leading edge reaches the exit sensor 35 the ADF motor 17 and the aligner roll motor are started, the entry gate 29 is dropped and the second document begins feeding around the turnaround guides 25 and 26 to repeat the cycle. The exit gate 32 is closed after a preset time interval and the belt and aligner rolls are run for a sufficient time to stop the second document on platen 31.

The above-mentioned steps continue to repeat until the last document in the stack has been copied and exited.

It is the unique configuration of turnaround guides 25 and 26, nip rollers 19 and 20, and restraint pad 24 that provides second-sheet restraint. As the topmost sheet of paper is shingled into the nip rollers and driven into the turnaround guides, the moving sheet is pulled down onto the restraint pad 24. Thus, if a second sheet is tacked to the topmost sheet and moving with it, it would be trapped against the edge of the restraint pad or between the restraint pad 24 and the topmost sheet, thus preventing a double-sheet feed. To facilitate this operation, the guide plate 25 is closely spaced to restraint pad 24 so that the topmost sheet is kept in proximity to the pad as it is driven by the nip rollers. Because of the configuration provided, it is possible to interrupt the ADF processing of a large stack of documents in order to process a smaller number of documents through the SADF. The arrangement provides a mechanism such that there is no need to lift the ADF out of the way and no need to remove the remaining documents from the ADF in order to interrupt that processing in favor of the smaller number. Instead, an ADF interrupt push button is provided such that the operation is interrupted while the SADF is utilized. Once the smaller number of documents has been processed, an ADF restore button is pushed and the processing of the larger stack of documents is automatically resumed.

Figure 3A:
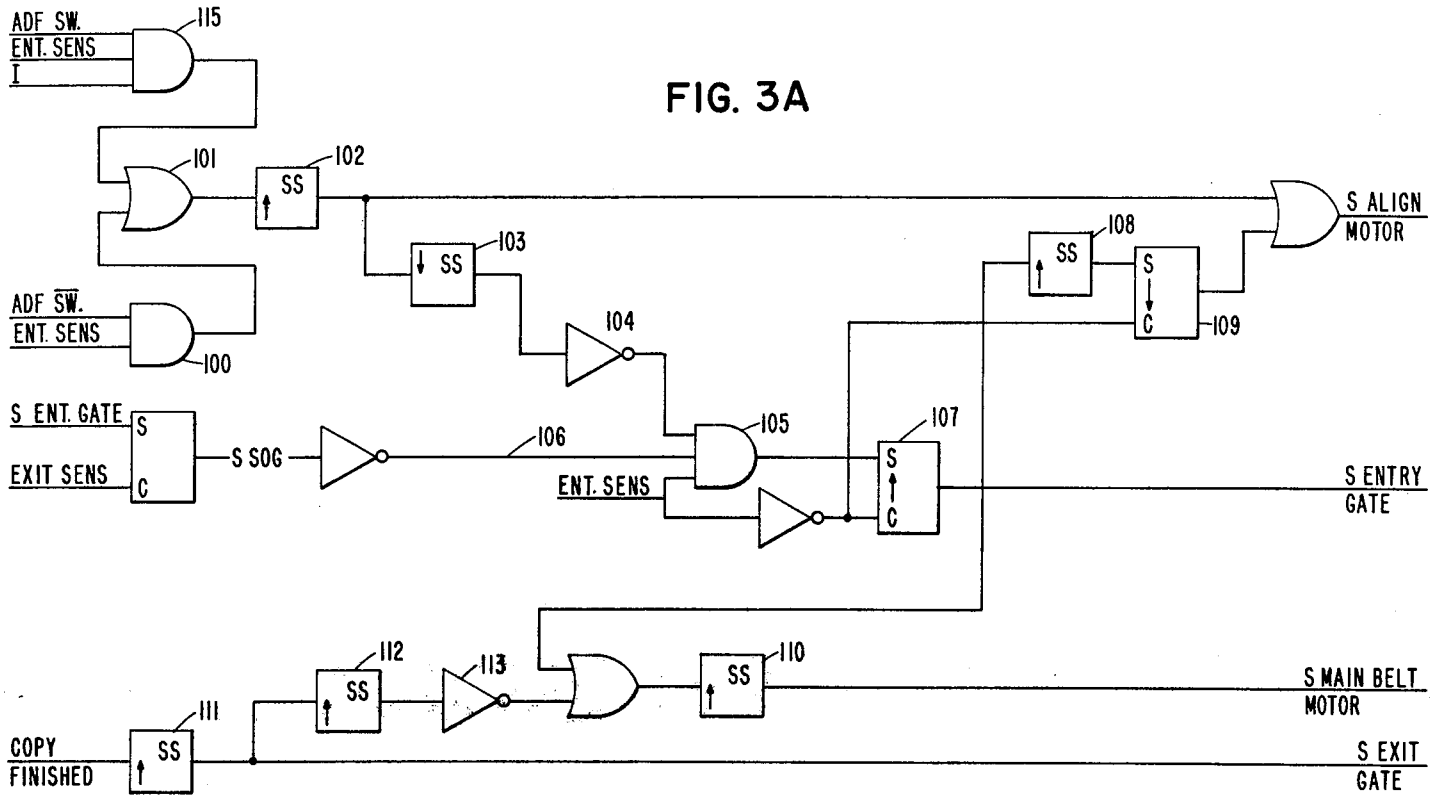
FIGS. 3 and 4 show the circuit schematic diagrams for SADF and ADF operations, respectively.
Figure 3B:
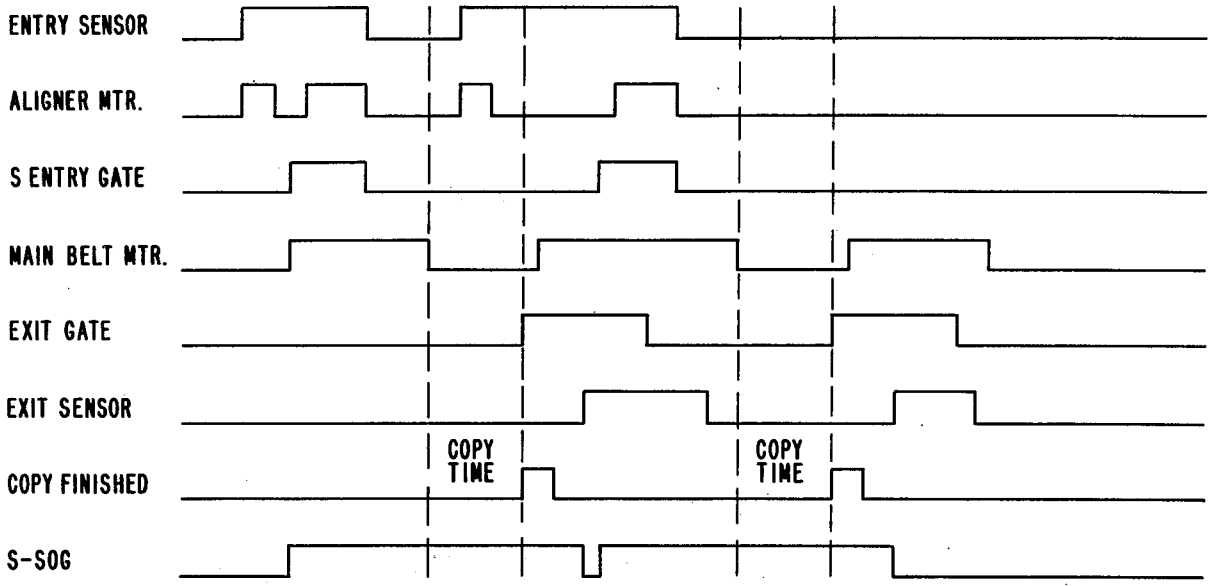

FIG. 3, comprised of FIGS. 3A and 3B, shows the circuit diagram for SADF operation. AND gate 100 is satisfied whenever a sheet of paper is inserted onto tray 22 to the entry sensor 34, and whenever there is no paper in feeding position on the ADF tray 10. For this condition, AND circuit 100 supplies a pulse through OR circuit 101 to a single-shot circuit 102. The direction of the arrow on single shot 102 indicates that the circuit operates from the leading edge of the signal supplied from OR circuit 101. Single shot 102 supplies a signal of specific time duration to the aligning rolls to move the sheet on tray 22 to the entry gate 27. Single shot 103 operates from the trailing edge of the signal supplied from single shot 102 through inverter 104 to supply AND circuit 105. If the entry sensor indicates the presence of a paper on tray 22 and if line 106 is raised, AND gate 105 will be satisfied. Line 106 is raised when the entry gate is in the up or closed position. With these conditions present, AND circuit 105 sets latch 107 which lowers the entry gate. A signal is also supplied through single shot 108 and latch 109 to resume rotation of the aligner rolls. Also, a signal is sent to the single shot 110 to begin rotation of the main drive belt. In that manner, a sheet positioned on tray 22 is moved by the aligner rolls and the main belt over the lowered entry gate onto the document glass. The drive belt motor is stopped after a period of time set by single shot 110 while the aligner rolls are halted when latch 109 is cleared by the trailing edge of the paper leaving the entry sensor. This also clears latch 107 which raises the entry gate.

When the copy operation is finished a signal is received from the copy machine and supplied to single shot 111 which lowers the exit gate. Single shot 111 also operates through single shot 112 and inverter 113 to operate single shot 110 and turn on the main belt. In that manner the paper is moved from the document glass, across the lowered exit gate, out of the viewing station.

If a second sheet had been placed onto tray 22 while the first sheet was at the viewing station, single shot 102 would be energized as previously described to turn on the aligner rolls and move the second sheet to the entry gate. Line 106 would remain low, holding the second sheet until the copy process is completed and the first document makes the exit sensor.

Figures 4A, 4B, 4C, 4D:
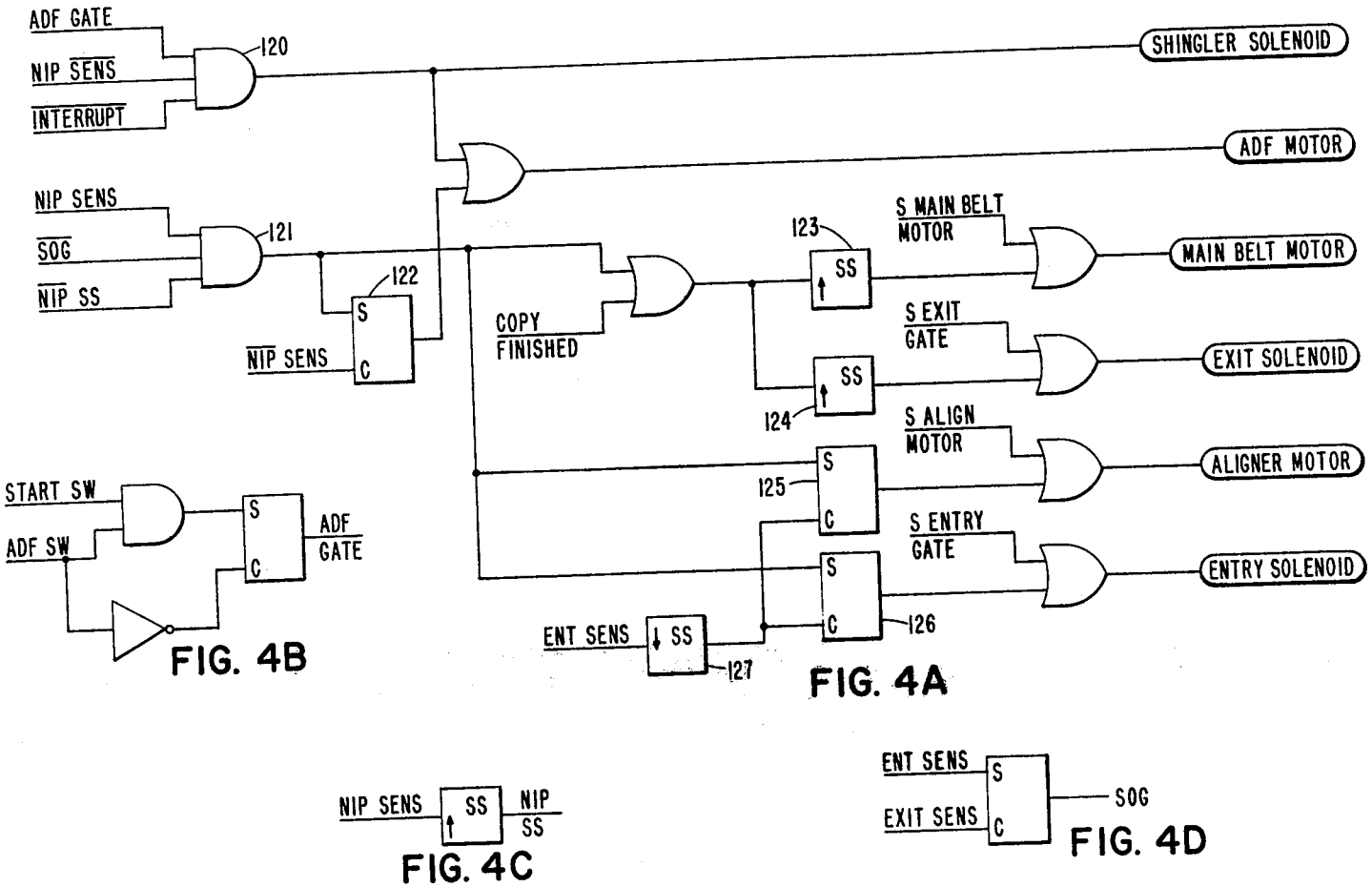
Figure 4E:
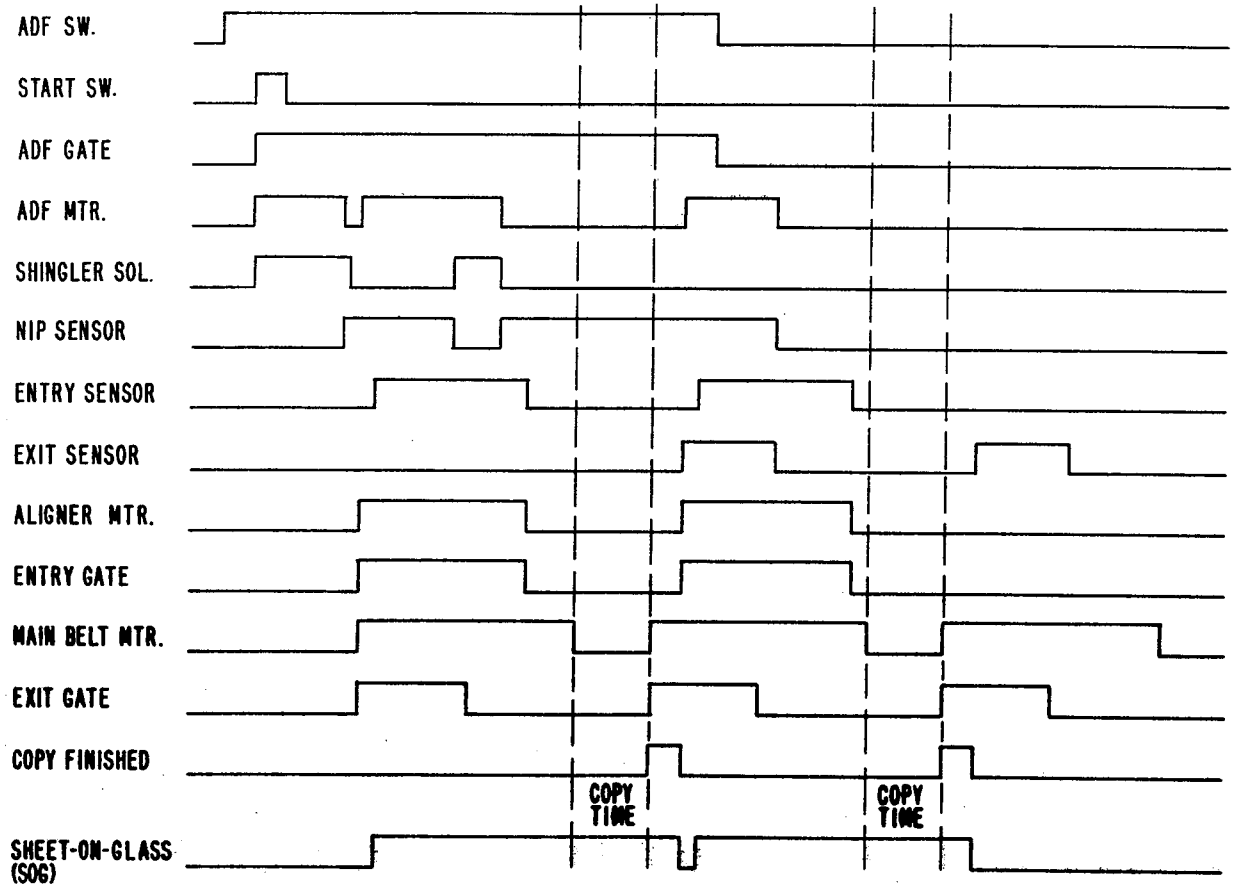

FIG. 4, comprised of FIGS. 4A–4E, shows the operation of the automatic document feed. Referring first to FIG. 4B, note that the ADF gate signal is raised when paper is properly positioned on tray 10 against ADF gate 15 and the start switch is pressed. Referring now to FIG. 4A, AND gate 120 is satisfied when the ADF gate signal is present together with no interrupt signal and no paper in the nip sensor. Under these conditions, pressing the start switch enables AND gate 120, which energizes the shingler solenoid 16 to lower paper feed means 13, and energizes ADF motor 17 to feed paper to the nip of nip rollers 19 and 20. When the topmost sheet reaches nip sensor 36, the AND gate 120 is dropped, turning off ADF motor 17 and raising paper feed means 13.

AND gate 121 is satisfied shortly after the nip sensor is raised through a time delay provided by a nip single-shot circuit shown in FIG. 4C. Note, however, that an absence of the sheet-on-glass (SOG) signal must be present. This SOG signal is shown in FIG. 4D and requires the entry sensor to be clear. When these conditions are satisfied, a pulse is supplied to latch 122 to start the ADF motor and thus turn the nip rollers to send the sheet of paper on its way to the viewing station. Circuit 121 also supplies a pulse to single shot 123 which operates the main belt motor and to single shot 124 for operating the exit solenoid. In that manner the exit gate is dropped and the main belt drives any sheet remaining on the glass from the glass.

A signal is also supplied from AND gate 121 to set the latches 125 and 126 in order to turn on the aligner motor and to drop the entry gate. Thus, the first sheet to be copied is fed from the nip rollers, through the aligner rollers, over the entry gate, onto the document glass where it will reposition against the exit gate which will have raised when the single shot 124 times out.

After the trailing edge of the document passes by the entry sensor, single shot 127 will be raised, resetting the latch 126 and causing the entry gate to raise, resetting the latch 125, turning off the aligner motor. Meanwhile, as soon as the trailing edge of the paper has left the nip sensor, AND gate 120 will be reenergized to shingle the next sheet to be copied up to the nip sensor by lowering the wave generator wheel 13 through the shingler solenoid 16 and turning on the ADF motor 17.

After a copy has been finished, the machine supplies a signal to single shots 123 and 124 to energize the exit solenoid and turn the main belt motor on to remove that copy from the document glass. After the sheet has been removed from the glass, AND gate 121 is made so that the ADF motor, the main belt motor, the aligner motor and the two gate solenoids are energized so as to bring the next sheet onto the document glass. In that manner the process continues until all sheets on tray 10 have been copied.

Should one want to interrupt the processing of the ADF in order to make copies through the use of the SADF tray 22, an interrupt button I is pushed. In that manner the operation of the AND circuit 120 is inhibited, thus halting ADF operations once the sheet already on the document glass has been copied. At the same time, referring now to FIG. 3A, the AND gate 115 is made by document entry under the entry sensor 34 and thus single shot 102 is energized to turn on the aligner roll motors and to provide an input to AND gate 105 in order to operate the entry gate as previously described. The operation of the SADF will continue until the interrupt restore button is pressed, thus enabling AND gate 120 and the ADF operation to resume.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. A document feed mechanism for serially feeding sheets from a stack of documents to a viewing station located directly under said stack comprising:

a tray for holding said stack;

ramp means located near the end of said stack;

a continuously closed pair of nip rollers;

a restraint pad located between said nip rollers and the exit of said ramp means;

paper feed means to move the topmost sheet from said stack up said ramp means across said restraint pad and down into the nip of said nip rollers;

guide means extending from above said ramp and said restraint pad to just above said nip for guiding the topmost sheet over said restraint pad and down into said nip;

electric motor means for simultaneously driving said nip rollers and said paper feed means further including a nip sensor located at the exit of said nip rollers;

actuator means to position said paper feed means onto the topmost sheet of said stack; and braking means to stop said motor when the leading edge of the topmost sheet reaches the nip sensor, said nip sensor signaling said braking means to stop said motor and said actuator means to lift said paper feed means from engagement with said stack.

2. In a document copier machine, an automatic document feed device comprising a tray for holding stacks of documents, wave generator document feeding means and nip rollers for receiving documents fed by said feeding means, a method for serially feeding said documents to a document glass at which said documents are held in a stationary manner during the copying operation comprising the steps of:

(1) manually loading a stack of documents onto said tray;

(2) activating said feeding means to move said documents in a shingled manner to cause the first topmost document to move up a ramp, across a restraint pad and down into the nip area of said nip rollers;

(3) halting the feeding of said topmost document when the leading edge thereof is sensed by sensing means at a position just beyond said nip area;

(4) activating said nip rollers to move said topmost document through a guideway toward said document glass, said topmost document being pulled down onto said restraint pad so that subsequent documents, if moved, are directed into said restraint pad;

(5) positioning said document on said glass;

(6) making the requisite number of copies;

(7) during the time frame of step 6, operating said feeding means to move the second topmost document up said ramp, across said restraint pad and down into said nip area until said sensing means senses the leading edge thereof and halts the feeding operation;

(8) after the conclusion of step 6, moving the first document off of said glass;

(9) reactivating said nip rollers to move the second document to said document glass; and

(10) repeating the steps of the method until all documents in said stack have been copied.

3. The method of claim 2 in which the nip rollers remain continually closed.

* * * * *